US010672268B1

(12) United States Patent
Weader

(10) Patent No.: US 10,672,268 B1
(45) Date of Patent: Jun. 2, 2020

(54) TRAFFIC SIGNAL INDICATING SIGN

(71) Applicant: Roderick Weader, N. Charleston, SC (US)

(72) Inventor: Roderick Weader, N. Charleston, SC (US)

( * ) Notice: Subject to any disclaimer, the term of this patent is extended or adjusted under 35 U.S.C. 154(b) by 0 days.

(21) Appl. No.: 16/417,778

(22) Filed: May 21, 2019

(51) Int. Cl.
*G08G 1/095* (2006.01)
*G09F 13/04* (2006.01)
*G08G 1/07* (2006.01)

(52) U.S. Cl.
CPC ..... *G08G 1/095* (2013.01); *G08G 1/07* (2013.01); *G09F 13/0413* (2013.01); *G09F 2013/0472* (2013.01)

(58) Field of Classification Search
CPC ..... G08G 1/095
USPC ..... 340/907, 905, 908, 928, 929, 332, 471; 701/93, 117
See application file for complete search history.

(56) References Cited

U.S. PATENT DOCUMENTS

| | | | | |
|---|---|---|---|---|
| D158,451 | S | 5/1950 | Ferguson | |
| 4,827,258 | A | 5/1989 | Evans | |
| 6,331,824 | B1 | 12/2001 | Firestone | |
| 7,671,760 | B2 * | 3/2010 | Vallejo, Sr. | G08G 1/095 340/332 |
| 9,064,411 | B1 | 6/2015 | Patton, Jr. | |
| 10,032,372 | B1 | 7/2018 | De Nava | |
| 10,403,142 | B1 * | 9/2019 | Shuff | G06T 7/0004 |
| 2003/0048201 | A1 | 3/2003 | Weiss | |
| 2004/0008127 | A1 * | 1/2004 | Manavi | G08G 1/087 340/907 |
| 2004/0189491 | A1 * | 9/2004 | Aydin | G08G 1/096 340/925 |
| 2006/0061487 | A1 * | 3/2006 | Heap | G09F 13/22 340/908 |
| 2009/0135024 | A1 * | 5/2009 | Park | G08G 1/095 340/929 |
| 2010/0117860 | A1 | 5/2010 | Agafonov | |
| 2018/0033259 | A1 * | 2/2018 | Cummings | G09F 19/22 |

FOREIGN PATENT DOCUMENTS

| | | |
|---|---|---|
| WO | 2008097129 | 8/2008 |

* cited by examiner

*Primary Examiner* — Tai T Nguyen
(74) *Attorney, Agent, or Firm* — Kyle A. Fletcher, Esq.

(57) ABSTRACT

The improved traffic signal indicating sign may be coupled to a motorist warning such as a traffic signal or to a traffic sign in advance of the traffic signal. The improved traffic signal indicating sign may extend beyond the edges of the motorist warning to which it is coupled and may call attention to the motorist warning. A backplate surrounding the motorist warning may comprise an inner border and an outer border. The inner border may comprise a plurality of border indicator lights which may be associated with the traffic signal and may be communicatively coupled, either directly or indirectly, to a controller for the traffic signal such that the border indicator lights may change to reflect the state of the traffic signal. The outer border may comprise a reflective strip to further increase awareness.

19 Claims, 4 Drawing Sheets

TRAFFIC SIGNAL INDICATING SIGN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of traffic safety, more specifically, an improved traffic signal indicating sign.

SUMMARY OF INVENTION

The improved traffic signal indicating sign may be coupled to a motorist warning such as a traffic signal or to a traffic sign in advance of the traffic signal. The improved traffic signal indicating sign may extend beyond the edges of the motorist warning to which it is coupled and may call attention to the motorist warning. A backplate surrounding the motorist warning may comprise an inner border and an outer border. The inner border may comprise a plurality of border indicator lights which may be associated with the traffic signal and may be communicatively coupled, either directly or indirectly, to a controller for the traffic signal such that the border indicator lights may change to reflect the state of the traffic signal. The outer border may comprise a reflective strip to further increase awareness.

An object of the invention is to increase awareness of a motorist warning such as a traffic signal or a traffic signal in advance of the traffic signal.

Another object of the invention is to provide a plurality of border indicator lights on a border of a backplate around the motorist warning.

A further object of the invention is to synchronize the state of the border indicator lights with the state of the traffic signal that the lights are associated with.

Yet another object of the invention is to provide a yellow reflector surrounding the motorist warning.

These together with additional objects, features and advantages of the improved traffic signal indicating sign will be readily apparent to those of ordinary skill in the art upon reading the following detailed description of the presently preferred, but nonetheless illustrative, embodiments when taken in conjunction with the accompanying drawings.

In this respect, before explaining the current embodiments of the improved traffic signal indicating sign in detail, it is to be understood that the improved traffic signal indicating sign is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved traffic signal indicating sign.

It is therefore important that the claims be regarded as including such equivalent construction insofar as they do not depart from the spirit and scope of the improved traffic signal indicating sign. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
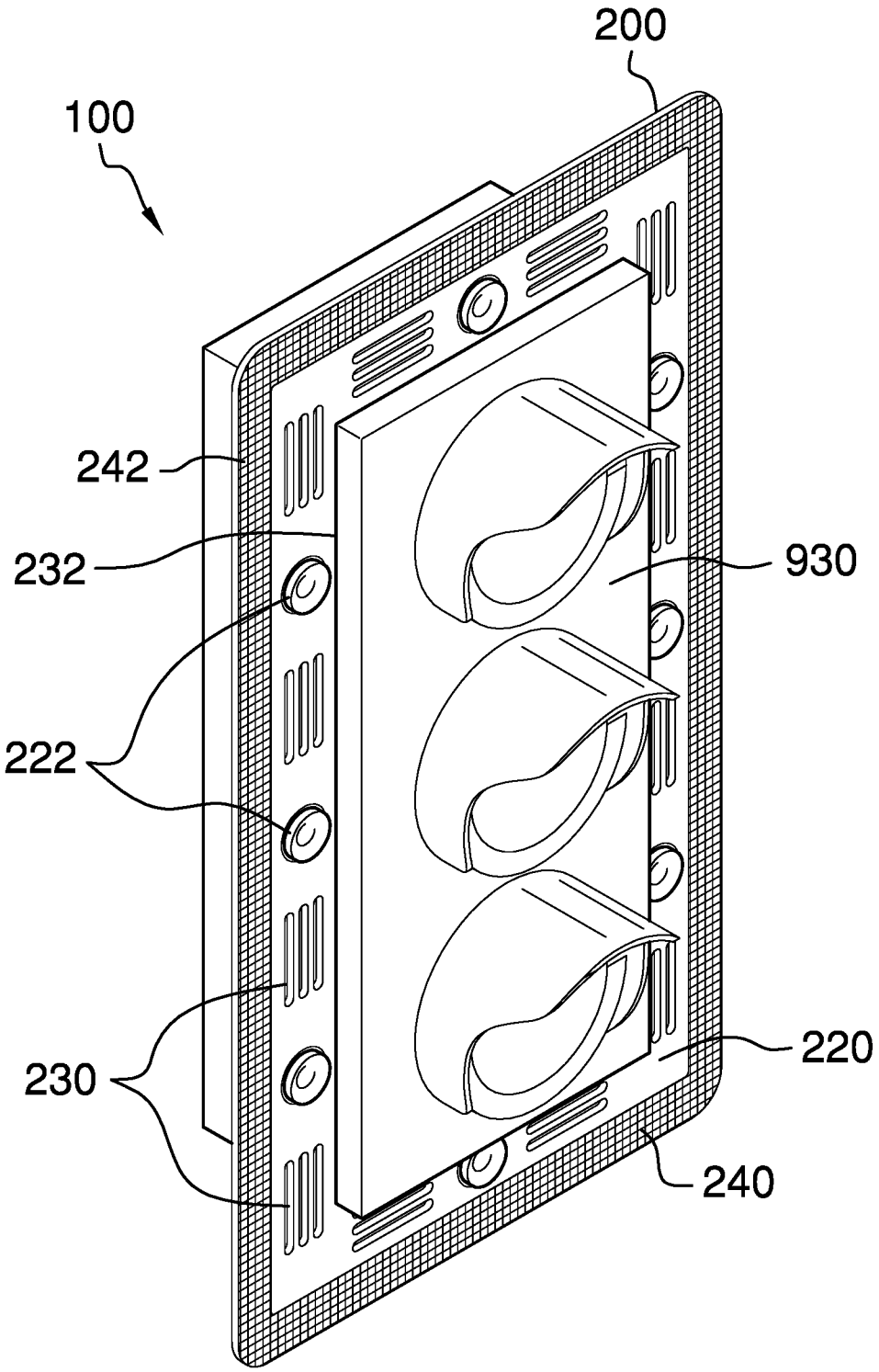
FIG. 1 is a perspective view of an embodiment of the disclosure.
Figure 2:
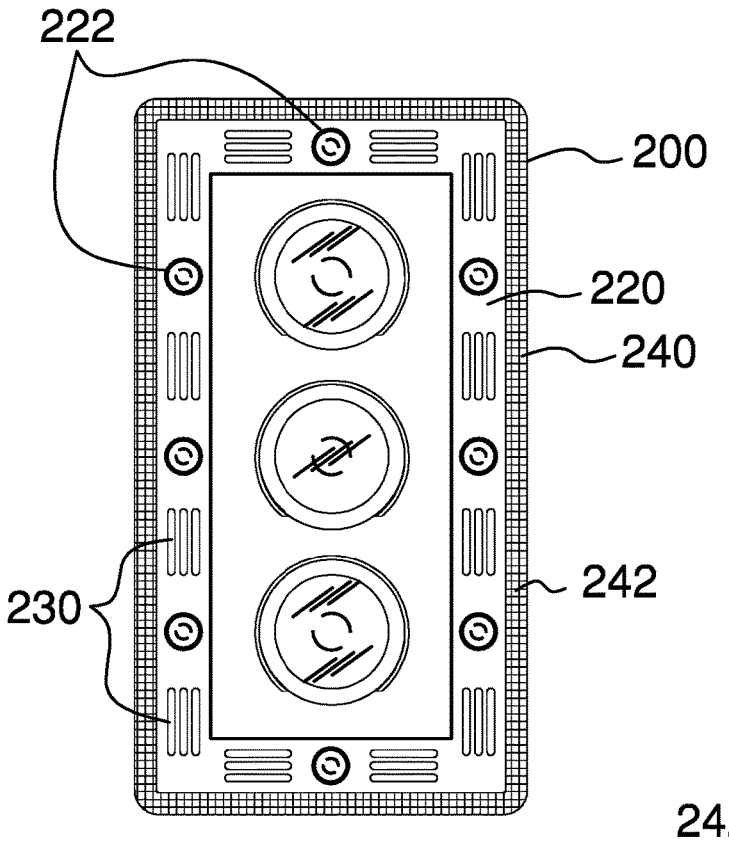
FIG. 2 is a front view of an embodiment of the disclosure illustrating the backplate surrounding a three-light traffic signal.
Figure 3:
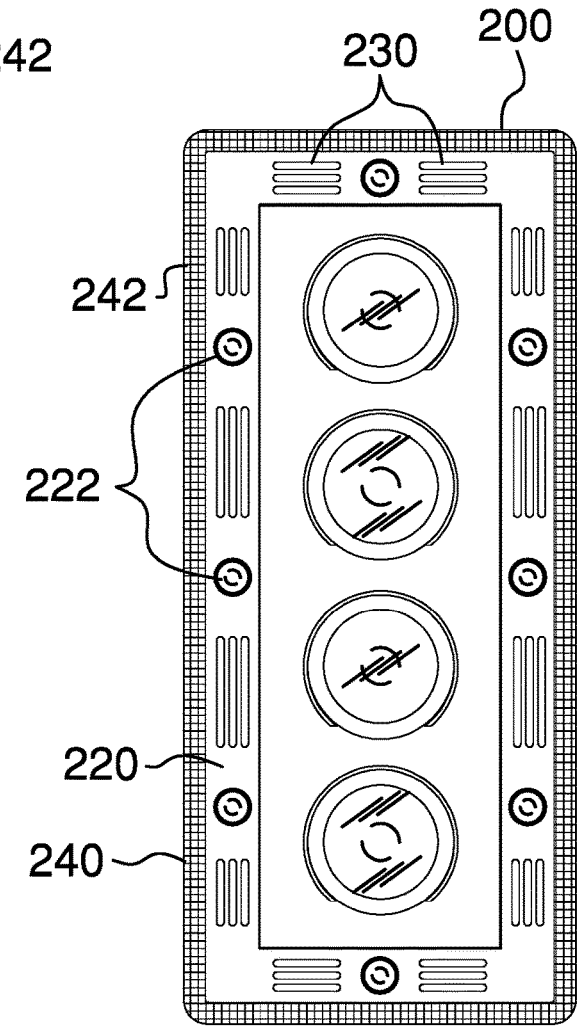
FIG. 3 is a front view of an alternative embodiment of the disclosure illustrating the backplate surrounding a four-light traffic signal.
Figure 4:
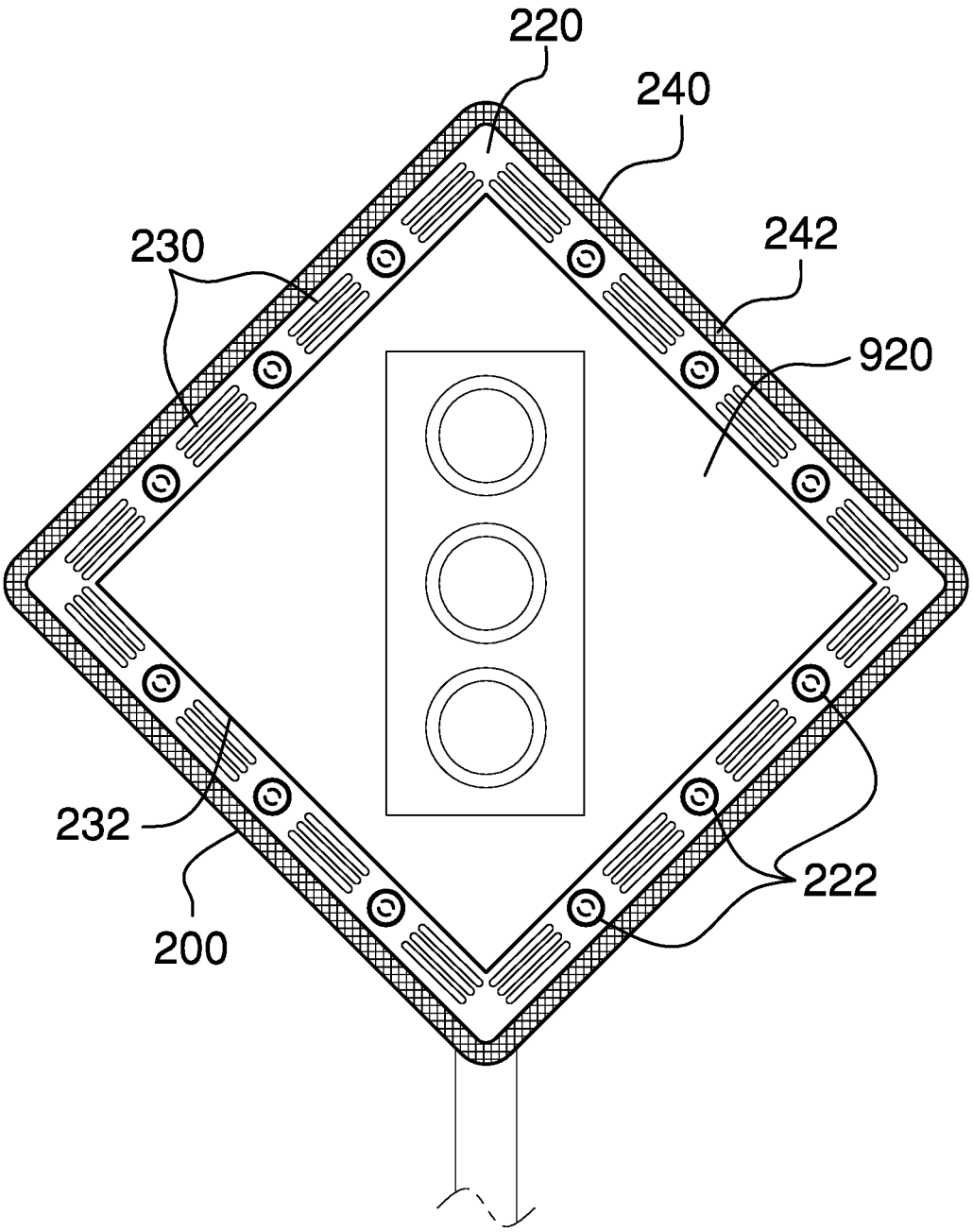
FIG. 4 is a front view of an alternative embodiment of the disclosure illustrating the backplate surrounding a traffic sign.
Figure 5:
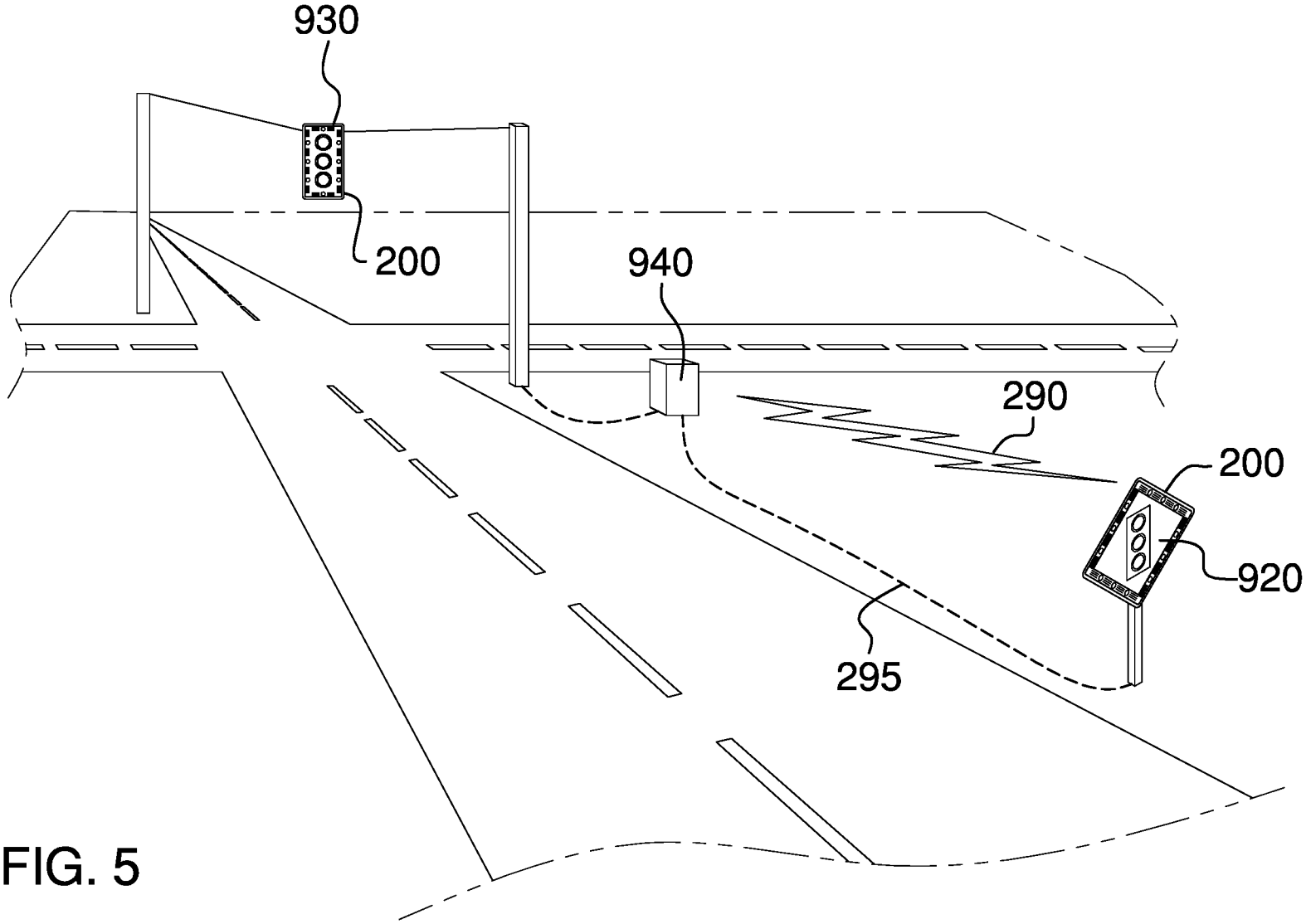
FIG. 5 is an in-use view of an embodiment of the disclosure illustrating communication between border indicator lights on a traffic sign and the associated traffic signal and its controller.

Detailed reference will now be made to a first potential embodiment of the disclosure, which is illustrated in FIGS. 1 through 5.

The improved traffic signal indicating sign 100 (hereinafter invention) comprises a backplate 200 and a plurality of border indicator lights 222. The backplate 200 may be coupled to a motorist warning and may extend beyond the edges of the motorist warning to provide an inner border 220 and an outer border 240 around the motorist warning. The plurality of border indicator lights 222 may be located on the inner border 220. The plurality of border indicator lights 222 may be associated with a traffic signal 930 and may be communicatively coupled, either directly or indirectly, to a controller 940 for the traffic signal 930.

As used herein, "motorist warning" refers to the traffic signal 930 or to a traffic sign 920 located in advance of the traffic signal 930 for the purpose of warning of the traffic signal 930. Without limitation, the invention 100 may be used in groups, to increase awareness of both the traffic signal 930 and the traffic sign 920 in advance of the traffic signal 930.

The backplate 200 may be a rigid plate that couples to the motorist warning. The shape of the backplate 200 may follow the shape of the motorist warning. The backplate 200 may improve awareness of the motorist warning to which it is coupled. The backplate 200 may make the motorist warning appear to be larger thus making it more obvious and blocking the sun in circumstances where the sun is behind the motorist warning. The backplate 200 may comprise visibility features to attract attention. The visibility features, described below, may include illuminated and/or reflective devices as non-limiting examples. In some embodiments, the backplate 200 may comprise a central cutout 232 such that the motorist warning may break the plane of the backplate 200.

The backplate 200 may comprise the inner border 220 and the outer border 240 which may be coplanar portions of the backplate 200. The inner border 220 may surround the motorist warning proximal to the motorist warning. The outer border 240 may surround the inner border 220 and may be distal to the motorist warning.

The inner border 220 may be a portion of the backplate 200 adjacent to the motorist warning that surrounds the motorist warning. The inner border 220 may be substantially the same width over its entire path. In some embodiments, the inner border 220 may be black such that higher contrast is achieved between the inner border 220 and the outer border 240. In some embodiments, the width of the inner border 220 as measured from the motorist warning to the outer border 240 may be 3 inches. In some embodiments, the inner border 220 may comprise a plurality of vents 230 to reduce wind resistance. The plurality of vents 230 may be one or more apertures or louvers that allow air to pass through the backplate 200.

The outer border 240 may be a portion of the backplate 200 adjacent to the inner border 220 that surrounds the motorist warning. The outer border 240 may be substantially the same width over its entire path. In some embodiments, the outer border 240 may be yellow such that the outer border 240 is more likely to attract the attention of a motorist. In some embodiments, the width of the inner border 220 as measured from the inner border 220 to the edge of the backplate 200 may be 2 inches. In some embodiments, the inner border 220 may comprise a reflective strip 242 to further improve visibility.

The inner border 220 may comprise the plurality of border indicator lights 222. As non-limiting examples, the plurality of border indicator lights 222 may be one or more LEDs. When illuminated, the plurality of border indicator lights 222 may attract attention to the motorist warning. The plurality of border indicator lights 222 may be disposed on the inner border 220 with a predetermined pattern and spacing. The state of the plurality of border indicator lights 222 may match the state of the traffic signal 930 that is associated with the plurality of border indicator lights 222. As non-limiting examples, the plurality of border indicator lights 222 may illuminate and extinguish as the traffic signal 930 is illuminated and extinguished, the color of the plurality of border indicator lights 222 may match a color or state of the traffic signal 930, flashing of the plurality of border indicator lights 222 may match the flashing state of the traffic signal 930, or combinations of these.

In some embodiments, the plurality of border indicator lights 222 may be multi-color. As non-limiting examples, each individual border light selected from the plurality of border indicator lights 222 may change color based upon the voltage applied, the combinations of contacts that are powered, a serialized message communicated to the individual border light through one or more contacts, other color selection mechanisms, or combinations of these. As non-limiting examples, the individual border light may glow red, amber, or green when illuminated.

In some embodiments, the inner border 220 may comprise 4 or more of the individual border lights. At least one of the plurality of border indicator lights 222 may be located on each side of the motorist warning—above the motorist warning, below the motorist warning, to the left of the motorist warning, and to the right of the motorist warning.

In some embodiments, the backplate 200 may surround and couple directly to the traffic signal 930. The plurality of border indicator lights 222 may be electrically coupled to the traffic signal 930.

In some embodiments, the inner border 220 may comprise 8 border indicator lights surrounding the traffic signal with 1 border indicator light above the motorist warning, 1 border indicator light below the motorist warning, 3 border indicator lights to the left of the motorist warning, and 3 border indicator lights to the right of the motorist warning.

In some embodiments, the backplate 200 may surround and couple to the traffic sign 920 that is located remotely from the traffic signal 930. The plurality of border indicator lights 222 may be coupled, either via a wireless link 290 or via a cable 295, to the controller 940 for the traffic signal 930.

In use, the invention 100 is coupled to the traffic signal 930, to the traffic sign 920, or both. Electrical or wireless connections between the plurality of border indicator lights 222 and the traffic signal 930, the controller 940, or both are established. As the traffic signal 930 cycles through its states, the plurality of border indicator lights 222 on the inner border 220 of the backplate 200 may also change state to show an appropriate warning of the state of the traffic signal 930. As non-limiting examples, as the traffic signal 930 changes from red to green, the plurality of border indicator lights 222 on the traffic signal 930, on the traffic sign 920, or both, may change from red to green. As the traffic signal 930 changes from green to amber, the plurality of border indicator lights 222 on the traffic signal 930, on the traffic sign 920, or both, may change from green to amber. As the traffic signal 930 changes from amber to red, the plurality of border indicator lights 222 on the traffic signal 930, on the traffic sign 920, or both, may change from amber to red. If the traffic signal 930 enters four-way flash mode (as may happen due to a power failure, safety officer override, to due to late-night, low traffic volume programming), the plurality of border indicator lights 222 on the traffic signal 930, on the traffic sign 920, or both, may flash the same color as the traffic signal 930 that they are associated with.

Definitions

As used in this disclosure, an "aperture" is an opening in a surface. Aperture may be synonymous with hole, slit, crack, gap, slot, or opening.

As used in this disclosure, a "cable" is a collection of insulated wires covered by a protective casing that is used for transmitting electricity or telecommunication signals.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "light" is an electrical device that generates visible light to illuminate objects so they can be seen.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used herein, "rigid" refers to an object or material which is inflexible. If a force is applied to a rigid object the rigid object does not bend or deform unless the force applied reaches the breaking point of the rigid object.

As used in this disclosure, a "sign" is a placard that displays an image, potentially including a text based image, which contains some form of a sentiment.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used herein, "traffic signal" (also known as a "traffic light" or "stop light") refers to an illuminated traffic control that may direct the flow of traffic through an intersection or on a road. The position, color, and flashing state of each light may be significant. As non-limiting examples, red may indicate "stop", amber may indicate "caution", green may indicate "proceed if safe to do so", and flashing may indicate "attention", "temporarily out of service", or "stop then proceed with caution". One of the most commonly known traffic signals comprises vertically stacked red, amber, and green lights that cycle to alternate the right of way at an intersection. Non-limiting examples of other configuration of traffic signals include those with additional lights to signal turns, those with split stackings corresponding to more than one lanes of traffic, and those with only a single light such as those found in front of fire stations or at crosswalks.

As used in this disclosure, "wireless" is an adjective that is used to describe a communication channel that does not require the use of physical cabling.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An improved traffic signal indicating sign comprising:
- a backplate and a plurality of border indicator lights;
- wherein the backplate is coupled to a motorist warning and extends beyond edges of the motorist warning to provide an inner border and an outer border around the motorist warning;
- wherein the plurality of border indicator lights are located on the inner border;
- wherein the plurality of border indicator lights are associated with a traffic signal and are communicatively coupled, either directly or indirectly, to a controller for the traffic signal such that the plurality of border indicator lights change to reflect a state of the traffic signal;
- wherein the plurality of border indicator lights illuminate and extinguish as the traffic signal is illuminated and extinguished, a color of the plurality of border indicator lights matches a color or state of the traffic signal, flashing of the plurality of border indicator lights matches a flashing state of the traffic signal, or combinations of these.

2. The improved traffic signal indicating sign according to claim 1
- wherein the backplate is a rigid plate that couples to the motorist warning;
- wherein a shape of the backplate follows the shape of the motorist warning;
- wherein the backplate improves awareness of the motorist warning to which it is coupled;
- wherein the backplate makes the motorist warning appear to be larger thus making it more obvious and blocking the sun in circumstances where a sun is behind the motorist warning;
- wherein the backplate comprises visibility features to attract attention.

3. The improved traffic signal indicating sign according to claim 2 wherein the backplate comprises a central cutout such that the motorist warning breaks a plane of the backplate.

4. The improved traffic signal indicating sign according to claim 2
- wherein the backplate comprises the inner border and the outer border which are coplanar portions of the backplate;
- wherein the inner border surrounds the motorist warning proximal to the motorist warning;
- wherein the outer border surrounds the inner border and is distal to the motorist warning.

5. The improved traffic signal indicating sign according to claim 4
- wherein the inner border is a portion of the backplate adjacent to the motorist warning that surrounds the motorist warning;

wherein the inner border is substantially the same width over its entire path.

6. The improved traffic signal indicating sign according to claim 5 wherein the inner border is black such that higher contrast is achieved between the inner border and the outer border.

7. The improved traffic signal indicating sign according to claim 6 wherein the inner border comprises a plurality of vents to reduce wind resistance.

8. The improved traffic signal indicating sign according to claim 7 wherein the plurality of vents are one or more apertures or louvers that allow air to pass through the backplate.

9. The improved traffic signal indicating sign according to claim 6 wherein the outer border is a portion of the backplate adjacent to the inner border that surrounds the motorist warning;

wherein the outer border is substantially the same width over its entire path.

10. The improved traffic signal indicating sign according to claim 9 wherein the outer border is yellow such that the outer border is more likely to attract the attention of a motorist.

11. The improved traffic signal indicating sign according to claim 10 wherein the inner border comprises a reflective strip to further improve visibility.

12. The improved traffic signal indicating sign according to claim 11 wherein the inner border comprises the plurality of border indicator lights;

wherein when illuminated, the plurality of border indicator lights attract attention to the motorist warning;

wherein the plurality of border indicator lights are disposed on the inner border with a predetermined pattern and spacing;

wherein the state of the plurality of border indicator lights matches the state of the traffic signal that is associated with the plurality of border indicator lights.

13. The improved traffic signal indicating sign according to claim 12 wherein the plurality of border indicator lights are multicolor.

14. The improved traffic signal indicating sign according to claim 13 wherein each individual border light selected from the plurality of border indicator lights changes color based upon a voltage applied, a combinations of contacts that are powered, a serialized message communicated to the individual border light through one or more contacts, other color selection mechanisms, or combinations of these.

15. The improved traffic signal indicating sign according to claim 13 wherein the individual border light glows red, amber, or green when illuminated.

16. The improved traffic signal indicating sign according to claim 15 wherein the inner border comprises 4 or more of the individual border lights;

wherein at least one of the plurality of border indicator lights are located on each side of the motorist warning—above the motorist warning, below the motorist warning, to the left of the motorist warning, and to the right of the motorist warning.

17. The improved traffic signal indicating sign according to claim 15 wherein the backplate surrounds and couples directly to the traffic signal;

wherein the plurality of border indicator lights are electrically coupled to the traffic signal.

18. The improved traffic signal indicating sign according to claim 17 wherein the inner border comprises 8 border indicator lights surrounding the traffic signal with 1 border indicator light above the motorist warning, 1 border indicator light below the motorist warning, 3 border indicator lights to the left of the motorist warning, and 3 border indicator lights to the right of the motorist warning.

19. The improved traffic signal indicating sign according to claim 15 wherein the backplate surrounds and couples to a traffic sign that is located remotely from the traffic signal;

wherein the plurality of border indicator lights are coupled, either via a wireless link or via a cable, to the controller for the traffic signal.

* * * * *